US005809778A

United States Patent [19]

Nording

[11] Patent Number: 5,809,778

[45] Date of Patent: Sep. 22, 1998

[54] EXHAUST MANIFOLD WITH SHEET METAL INLET PIPES

[75] Inventor: Thomas Nording, Esslingen, Germany

[73] Assignee: J. Eberspächer GmbH & Co., Esslingen, Germany

[21] Appl. No.: 654,827

[22] Filed: May 29, 1996

[30] Foreign Application Priority Data

Jun. 16, 1995 [DE] Germany ..... 195 21 849.3

[51] Int. Cl.[6] ..... F01N 7/08; F01N 7/10; F01N 7/18

[52] U.S. Cl. ..... 60/323; 60/313; 60/322

[58] Field of Search ..... 60/323, 305, 306, 60/313, 289, 293, 324; 29/421.1, 890.08; 239/601; 72/49, 711; D23/266

[56] References Cited

U.S. PATENT DOCUMENTS

| | | | |
|---|---|---|---|
| 2,344,863 | 3/1944 | Ginn et al. . | |
| 2,859,509 | 11/1958 | Adams | 29/157.3 |
| 2,889,682 | 11/1959 | Steven et al. | 60/13 |
| 3,180,011 | 4/1965 | Heuer | 29/157.3 |
| 3,216,093 | 11/1965 | Tranel | 29/157 |
| 3,286,337 | 11/1966 | Sauve | 29/423 |
| 4,285,109 | 8/1981 | Kautzer et al. | 29/157 |
| 4,342,195 | 8/1982 | Lo | 60/313 |
| 4,373,329 | 2/1983 | Martini | 60/305 |
| 4,484,440 | 11/1984 | Oki et al. | 60/276 |
| 4,621,494 | 11/1986 | Fujita | 60/313 |
| 4,813,232 | 3/1989 | Hitomi et al. | 60/313 |
| 4,815,274 | 3/1989 | Piatti | 60/313 |
| 4,866,931 | 9/1989 | Hansen | 60/274 |
| 4,999,999 | 3/1991 | Takahashi et al. | 60/313 |
| 5,170,557 | 12/1992 | Rigsby | 29/890.08 |
| 5,349,817 | 9/1994 | Bekkering | 60/322 |
| 5,372,027 | 12/1994 | Roper et al. | 72/60 |
| 5,419,125 | 5/1995 | Fukae et al. | 60/289 |
| 5,471,857 | 12/1995 | Dickerson | 72/57 |
| 5,557,961 | 9/1996 | Ni et al. | 72/61 |
| 5,595,062 | 1/1997 | Chabry | 60/313 |
| 5,678,404 | 10/1997 | McManus | 60/313 |

FOREIGN PATENT DOCUMENTS

| | | | |
|---|---|---|---|
| 2644-207-A1 | 8/1990 | France | 29/890.08 |
| 32 16 980 | 11/1983 | Germany | F01N 7/10 |
| 59-201925 | 11/1984 | Japan . | |
| 64-80718 | 3/1989 | Japan | 60/313 |
| 3-275934 | 12/1991 | Japan . | |
| 5-52117 | 3/1993 | Japan . | |
| 493619 | 10/1938 | United Kingdom . | |
| A-493619 | 10/1938 | United Kingdom . | |
| A-2 058 917 | 4/1981 | United Kingdom . | |

OTHER PUBLICATIONS

Hashimoto Noboru Nov. 2, 1989 Exhaust Device for Multicylinder Engine *Patent Abstracts of Japan*, vol. 13, No. 484, Abstract only.

Iwashita Yoshihiro et al. Apr. 27, 1993 Control Device of Six–Cylinder Internal Combustion Engine *Patent Abstracts of japan*, vol. 17, No. 465, Abstract only.

*Primary Examiner*—Stephen F. Husar
*Assistant Examiner*—Ljiljana V. Ciric
*Attorney, Agent, or Firm*—McGlew and Tuttle

[57] ABSTRACT

Curved inlet pipes, which themselves are assembled from at least two curved individual pipes, are provided in an exhaust manifold with sheet metal inlet pipes from the respective cylinder head outlet to a common exhaust gas outlet. As a result, the sum of the moments of resistance is substantially smaller, especially in the case of short, curved inlet pipes, which prolongs the service life of a sheet metal exhaust manifold.

11 Claims, 2 Drawing Sheets

EXHAUST MANIFOLD WITH SHEET METAL INLET PIPES

FIELD OF THE INVENTION

The present invention pertains to an exhaust manifold with sheet metal inlet pipes or ducts which lead from a corresponding cylinder head outlet to a common exhaust gas outlet, wherein at least one curved inlet pipe or duct is provided.

BACKGROUND OF THE INVENTION

An essential problem of prior-art exhaust manifold with the above-mentioned structure is that of the service life during operation.

The exhaust manifold is heated by the exhaust gas having temperatures of up to about 1,000° C. The exhaust manifold reaches temperatures of a similar magnitude. A component commonly made and assembled from usual sheets of steel expands by about 1% under such conditions.

However, the hot, gas-carrying components of an exhaust manifold are welded to a cylinder head mounting flange, which usually has a substantially lower temperature level and therefore also expands much less during operation. This cylinder head mounting flange or its screw connection on the cylinder head thus hinders the thermal expansion of the exhaust manifold.

The hindered thermal expansion leads to stresses, which are more or less critical for the service life, depending on the design of the component. If the geometry is such that a very high rigidity develops due to, e.g., very short pipe sections or an unfavorable pipe profile, the stresses become so high that a satisfactory service life of exhaust manifolds is frequently not achieved.

The design freedoms are extremely limited in the particular case, and it is not possible to achieve a sufficient service life in the case of a conventional design. The chief cause of the high moment of resistance of the pipes against bending, which could compensate the thermal expansion, is the flat, box-shaped profile of the pipes of the outer cylinders. However, this is necessary according to the state of the art to ensure the accessibility of the bolts of the cylinder head mounting flange with a sufficient flow cross section of the exhaust manifold.

SUMMARY AND OBJECTS OF THE INVENTION

Based on the problem of the state of the art, the object of the present invention is to provide an exhaust manifold of the type described in the introduction, in which the service life is markedly increased by means of simple measures, without having to accept any disadvantages in terms of design or function.

According to the invention, an exhaust manifold is provided including one or more sheet metal inlet pipes or ducts for each cylinder. Each inlet pipe or duct being connected to a respective cylinder head outlet and extending to a common exhaust gas outlet. At least one of the inlet pipes or ducts is longitudinally curved. The individual pipes are complete conduits in and of themselves.

Each individual pipe parts or tubes are preferably each a one piece part. The individual pipe has a cross-sectional shapes that continuously transitions or varies in a longitudinal direction. A sum of the cross-sectional areas of the individual pipes at each point along their length, is substantially the same as that of a corresponding inlet pipe or duct of the prior art with only one pipe part or tube.

The individual pipes have an approximately 90° curve (an angle between the inlet axis parallel to an inlet end of the pipe and an exhaust axis parallel to an exhaust end of the pipe part is substantially equal to 90°).

The ends of individual pipes of the inlet duct are located at closely spaced locations from one another in an area of the cylinder head mounting flange or exhaust flange and in an area of the exhaust gas outlet. The cylinder head mounting flange and the exhaust gas outlet having connection component areas. Preferably, between the cylinder head mounting flange and the exhaust gas outlet, the individual pipes are located at spaced locations from one another. The individual pipes of an inlet pipe or duct are preferably inserted into the cylinder head mounting flange and into the central exhaust gas outlet, and are welded together by means of a fillet weld.

The exhaust manifold is preferably formed of a plurality of outer, curved inlet pipe or ducts and one central, straight inlet pipe or duct wherein each of the outer inlet pipes or ducts are assembled from two individual pipes each. The two outer inlet pipes or ducts are preferably arranged axially symmetrically with respect to each other. The symmetry is considered from a top view about the central pipe or duct as shown in FIG. 1. The outer inlet pipes or ducts are preferably made according to a hydrostatic shaping process.

The essence of the present invention is to assemble the curved, usually very short inlet pipe itself in an exhaust manifold made of shaped sheet metal parts from at least two curved individual pipes. The individual pipes, are preferably each one-piece individual components.

The basic idea of the present invention is to reduce the flexural strength of a usually box-shaped, curved, prior-art inlet pipe of large diameter by replacing the broad, box-shaped cross-sectional profile of the inlet pipe or duct with at least two narrower pipe sections arranged next to each other. The two narrower pipe sections have in combination a substantially lower moment of resistance and thus reduce the load during operation. As a result, prolonged service life or durability of an exhaust manifold made of sheet metal is made possible.

The present invention is particularly suitable in the case of very short, curved pipe sections or ducts, in which a very high moment of resistance is present according to the state of the art, and a reduction in the moment of resistance to about 25% of the moment of inertia of a single duct is conceivable due to a division of the pipe or duct into two or more parallel pipes sections.

The individual pipes are preferably inserted into the connection component areas on the inlet side and the outlet side and are welded by fillet welding. Individual pipes of one inlet pipe or duct that relate to one inlet pipe or duct are located at closely spaced locations from one another in the connection component area. The individual pipes of a single duct are otherwise advantageously located at spaced locations from one another over the rest of the curve of the exhaust duct in order to compensate for different amounts of thermal expansion in the curve of the individual pipes without mutually hindering each other.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
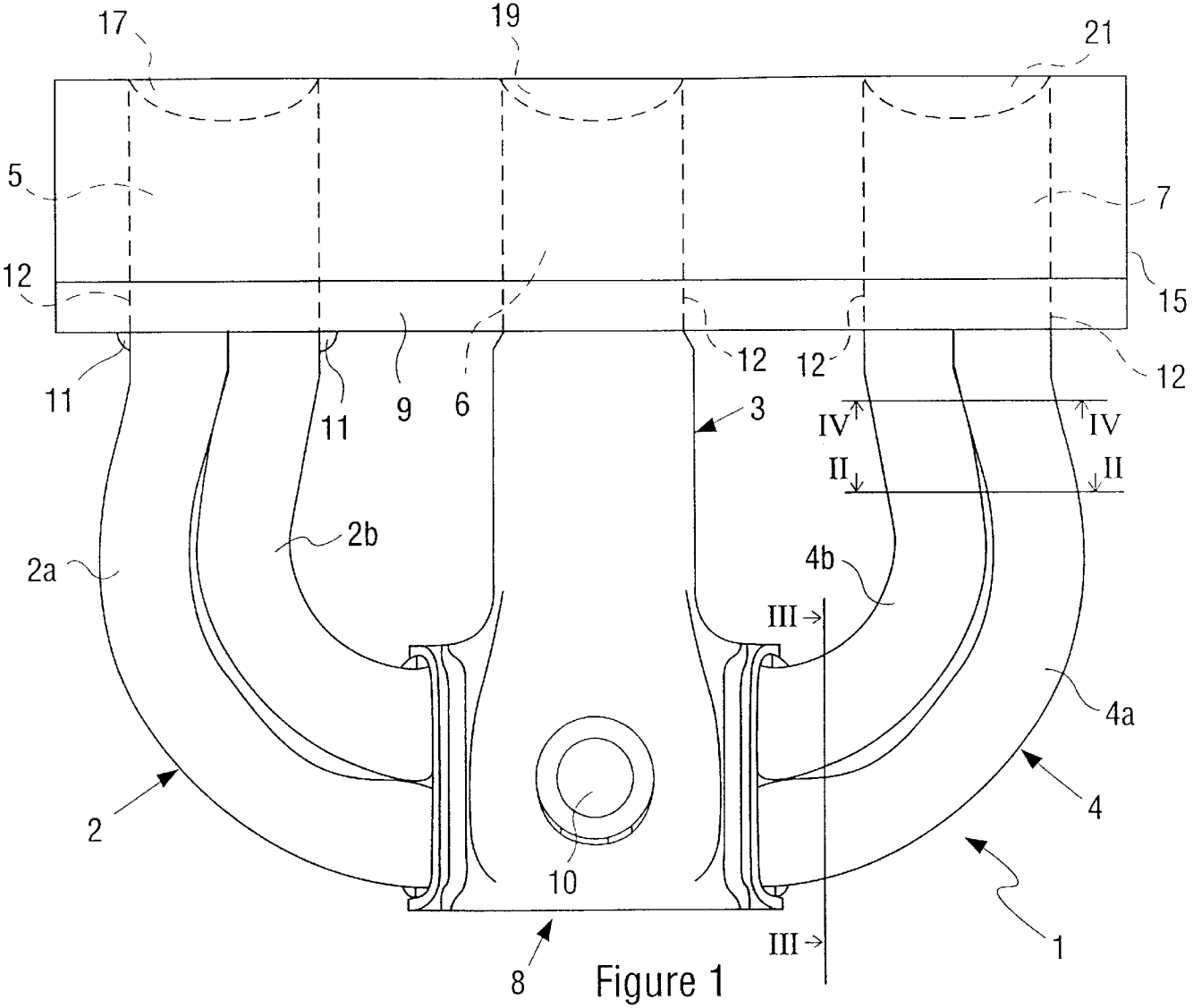
FIG. 1 schematically shows an axially symmetrical exhaust manifold made of shaped sheet metal parts with three inlets.
Figure 3:
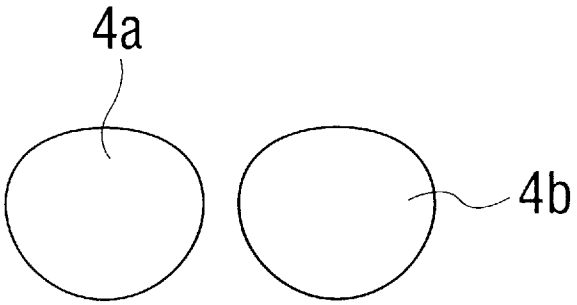
FIG. 3 is a sectional view along section line III-III of FIG. 1.
Figure 2:
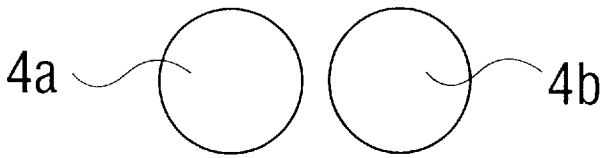
FIG. 2 is a sectional view along section line II-II of FIG. 1.
Figure 4:
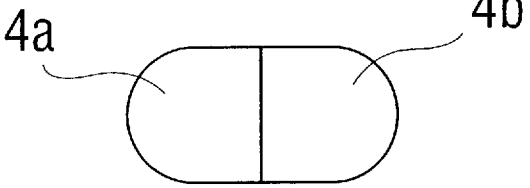
FIG. 4 is a sectional view along section line IV-IV of FIG. 1.

The exhaust manifold 1 according to the drawing comprises inlet pipes or ducts 2, 3, 4 each made separately of sheet metal and extend from the respective cylinder head outlet 5, 6, or 7 to a common exhaust gas outlet fitting 8. The cylinder head outlets 5,6,and 7 being located in an engine 15 and connecting to cylinders 17,19, and 21 respectively.

In particular, two outer inlet pipes or ducts 2, 4, which are designed as curved pipes or ducts, as well as one central, straight inlet pipe or duct 3 are provided.

The central, straight inlet duct 3 from the middle cylinder 19 is an individual single pipe of flat or box-shaped or oval cross section of a half-shell design, as according to the state of the art, and it has an opening 10 on the central top side for arranging a lambda probe. The common gas outlet 8 is located, e.g., under the opening 10 in the top view of the drawing, on the underside of the half shell of the individual straight pipe or duct 3.

Contrary to the central, straight inlet pipe or duct 3, the two outer, curved inlet pipe or ducts 2, 4 consist of two individual pipes 2*a*, 2*b* and 4*a*,4*b* each, which are not designed according to the half-shell design, but are one-piece pipe sections which are inserted on one end side into a flange opening 12 of the cylinder head mounting flange or exhaust flange 9 and into a connection component area 14 on the other side in the area of the common gas outlet 8. The ends of the pipes are welded together by a fillet weld 11.

The central inlet pipe or duct 3 and the connection component area 14 are designed as one piece in the exemplary embodiment shown in the drawing.

As can be seen in the exemplary embodiment shown in the drawing, the individual pipes 2*a*, 2*b* as well as 4*a*, 4*b* are located at closely spaced or adjacent locations from one another in their end-side insertion areas. However two individual pipes that belong to a single duct are located at slightly spaced locations from one another over the rest of the course of the curve in order to make possible unhindered, different thermal expansion in the curved area of an individual pipe.

While the individual pipes or tubes 2*a*, 2*b* as well as 4*a*, 4*b* have a substantially round cross section, with the exception of the mutual contact area in the insertion area of the cylinder head mounting flange 9, the insertion areas on the other side in the area of the common exhaust gas outlet 8 are substantially flat (on the top side shown) and oval (on the underside). The change in the cross section from "round" to "flat" or "oval" is continuous over the length of the curve.

While a specific embodiment of the invention has been shown and described in detail to illustrate the application of the principles of the invention, it will be understood that the invention may be embodied otherwise without departing from such principles.

What is claimed is:

1. An exhaust manifold for an internal combustion engine, said manifold comprising:

an exhaust flange connectable to the engine said exhaust flange defining a flange opening in communication with a corresponding cylinder outlet of the engine;

a plurality of pipes directly connected to, and in communication with, said flange opening, each of said plurality of pipes being longitudinally curved;

a common exhaust gas outlet fitting directly connected to, and in communication with, said plurality of pipes, wherein each of said pipes defines a single independent exhaust passageway between said flange opening and said common exhaust gas outlet fitting.

2. An exhaust manifold according to claim 1, wherein: each of said plurality of pipes is formed as an integral one-piece part.

3. An exhaust manifold according to claim 1, wherein: each of said plurality of pipes has a cross-sectional shape, said cross-sectional shape of each of said pipes varying in a continuous transition in a longitudinal direction.

4. An exhaust manifold according to claim 2, wherein: first pipe and a second pipe of said plurality of pipes have different cross-sectional shapes, said cross-sectional shape of each of said first pipe and said second pipe varying in a continuous transition in a longitudinal direction.

5. An exhaust manifold according to claim 1, wherein:

each pipe has an inlet opening and an outlet opening, and a first pipe and said a second pipe of said plurality of pipes are curved such that the plane comprising the inlet opening and the plane comprising the outlet opening of each pipe are disposed at an angle of approximately 90° relative to each other.

6. An exhaust manifold according to claim 1, wherein:

individual pipes of said plurality of pipes are disposed adjacent to one another said exhaust flange opening and also at the exhaust gas outlet said individual pipes being spaced from one another between said exhaust flange and said exhaust gas outlet.

7. An exhaust manifold according to claim 6, wherein:

said pipes are inserted into said exhaust flange and into said exhaust gas outlet, said pipes being welded to said exhaust flange via a fillet weld.

8. An exhaust manifold according to claim 1, wherein said inlet pipes are made in a hydrostatic shaping process.

9. An exhaust manifold in accordance with claim 1, further comprising:

said exhaust flange defining a plurality of flange openings, each of said flange openings being in communication with an individual cylinder outlet of the engine:

another plurality of pipes directly connected to, and in communication with, another one of said plurality of flange openings, said plurality of pipes being longitudinally curved, said common exhaust gas outlet fitting being directly connected to, and in communication with, said another plurality of pipes, wherein each pipe of said another plurality of pipes defines a single independent exhaust passageway between said another one of said plurality of flange openings and said common exhaust gas outlet fitting.

10. An exhaust manifold in accordance with claim 9, further comprising:

a straight duct directly connected to, and in communication with, still another one of said plurality of flange openings, said common exhaust gas outlet fitting being directly connected to, and in communication with, said straight duct, said straight duct conveying all exhaust gas from said still another one of said plurality of flange openings to said common exhaust gas outlet fitting, said still another one of said plurality of flange openings being positioned between said at least one of said plurality of flange openings and said another one of said plurality of flange openings.

11. An exhaust manifold in accordance with claim 9, wherein:

individual pipes of said plurality of pipes are positioned adjacent each other at said flange opening and also at said common exhaust gas outlet fitting, said plurality of pipes being spaced from each other between said flange exhaust and said common said exhaust gas outlet fitting.

* * * * *